United States Patent [19]

van den Haak

[11] Patent Number: 4,724,789

[45] Date of Patent: Feb. 16, 1988

[54] DEVICE FOR LAYING-OUT AND BREAKING-OUT OF THE SEA-BOTTOM AND WEIGHING AN ANCHOR

[76] Inventor: Rob van den Haak, Meerkoetstraat 83a, 2920 AC Krimpen A/D Ijssel, Netherlands

[21] Appl. No.: 924,206

[22] Filed: Oct. 28, 1986

[51] Int. Cl.[4] ..... B63B 21/22

[52] U.S. Cl. ..... 114/293; 294/66.1; 114/221 R

[58] Field of Search ..... 114/200, 210, 293, 294, 114/297, 299, 221 R; 294/66.1, 82.1; 43/17.2, 44.97

[56] References Cited

U.S. PATENT DOCUMENTS 3,929,087 12/1975 Montgomery ..... 114/297

4,067,287 1/1978 Sabella ..... 114/299

4,161,922 7/1979 Fogg ..... 114/299

4,186,464 2/1980 Sandoy ..... 114/200

OTHER PUBLICATIONS

European Patent Application, No. 0112301, Ibba 114/299, Jun. 1984.

European Patent Application, No. 0081258, Van den Haak, 114/210, June 1983.

*Primary Examiner*—Joseph F. Peters, Jr.

*Assistant Examiner*—Edwin L. Swinehart

*Attorney, Agent, or Firm*—Ladas & Parry

[57] ABSTRACT

A chaser of a hook type for laying-out and weighing an anchor and intended for tensioning of an anchor line to an embedded anchor.

7 Claims, 15 Drawing Figures

DEVICE FOR LAYING-OUT AND BREAKING-OUT OF THE SEA-BOTTOM AND WEIGHING AN ANCHOR

Figure 1A:
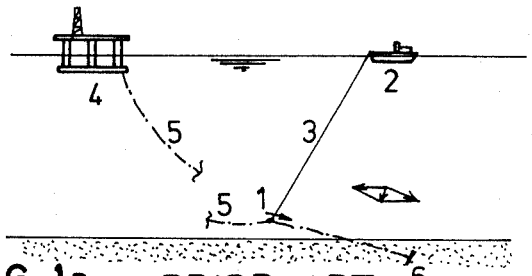
FIG. 1a PRIOR ART

Intensification of the exploration and exploitation of off-shore oil and gas fields during the past ten years has caused these operations to be moved to ever deeper waters. The result of this was that considerable scaling up occurred with respect to all the material being used for off-shore operations. Thus the dimensions of for instance anchor chains, anchor winches and of anchors themselves are considerably increased. Particularly the holding force efficiency of anchors is improved by a factor 3 to 6 in the last decennium.

In the initial phase of these off-shore activities. I.E. in the period that the exploration and exploitation of oil and gas occurrences was only restricted to relatively shallow parts of the continental shelf, the anchors by which floating objects such as drilling platforms, crane ships and the like can be anchored to the sea-bottom, were pulled out of or from the sea-bottom and weighed with the aid of so-called pennant wires. For this purpose one terminal end of such a pennant wire is attached to the anchor and the other terminal end to a so-called surface buoy. After laying out the anchors, which is often performed with tugboats or supply ships, these buoys floating on the sea surface indicate the positions where the anchors were located in or on the sea-bottom. Upon completion of the operations these anchors were weighed again by breaking these out or pulling these up from the sea-bottom with the aid of the pennant wires. In order to do so, the surface buoys together with the terminal ends of the pennant wires attached thereto were picked out of the water again with the aid of the tugboats or supply ships, after which the anchors were pulled out by their pennant wires. At the same time the anchor chains were pulled taut from the floating object with the aid of anchor winches and subsequently the anchors were hoisted on deck there or secured to anchor support frames fixed to the side of the object.

However, in the course of time these anchors were improved on several points. One of these improvements concerns the adaptation to have the anchors penetrate deeper. A deeper penetration, however, would not only yield an improvement of the holding force capacity, but also a proportional improvement of the breaking-out forces, particularly in softer types of soil. This would imply that much greater forces are required to pull an embedded anchor out of the bottom. This would further imply that the pennant wires have to be more heavily dimensioned so that the surface buoys have to be enlarged to be adapted to carry the higher own weight of the pennant wires.

In several sea areas, however, these large buoys have caused accidents, whereupon the use of said buoys was prohibited by the authorities in the countries surrounding the north sea in their sectors of the continental shelf. The more so since particularly fishing-boats ran into troubles in the dark of the night due to the presence of such buoys.

This problem was solved by making use of a specific device for laying-out and weighing an anchor, whereby the use of surface buoys could be eliminated.

A known device of this type is mostly called a "chaser" in the art. Of such a device mainly two variations are known. One type is generally referred to by the name "J-chaser". This device has, as the name already indicates, a J-shape which provides an open structure adapted to be hooked at any location about an anchor chain or cable. When not in use, the device can be stored on deck of the floating object as well as on deck of the tugboat of supply ship.

The other type is known by the name "permanent chaser". Broadly, this device comprises a ring-shaped means having such interior measures that it can easily slide along the anchor chain or cable and on the anchor shank. As the name already indicates, this device is permanently situated about the anchor chain and, when not in use, rests against an anchor support frame.

For laying-out an anchor from a floating object that has to be anchored in a certain position the "chaser" is slid onto the anchor shank ("J-chaser"), if it has not been incorporated permanently yet in the system of anchor+anchor chain ("permanent chaser") and this in such a way that the "chaser" is situated as close to the anchor crown as possible for the sake of stability. To the "chaser" a pennant wire is or has been attached, the other terminal end of which is connected to a winch aboard a tugboat or supply ship. With the aid of said winch, the pennant wire is kept under sufficient tension at all times so as to prevent the anchor from slipping out of the "chaser".

From the floating object the anchor chain or cable is gradually paid-out with the aid of an anchor winch, while at the same time the tugboat or supply ship slowly moves away from the object. By simultaneously paying-out the anchor chain or cable and the pennant wire the anchor is lowered down to the sea-bottom in a controlled manner and tugged to the desired anchoring position. The pennant wire preferably should be 1½ to 2 times the water depth.

When the anchor has been placed in the desired position, the tugboat or the supply ship is navigated back to the floating object, during which the "chaser" slides off the anchor shank. Then the "chaser" is taken along back to the floating object while sliding along the anchor chain.

If after completing or in order to interrupt the activites said anchor has to be weighed again, then, generally, is acted in reversed order. The "chaser" is now tugged by the tugboat or supply ship with the aid of the pennant wire from the floating object sliding along the anchor chain or cable in the direction of the anchor on the sea-bottom. When arriving there, the "chaser" easily slides about the anchor shank due to its adapted configuration to rest against the anchor crown. Then the anchor can be pulled out of or from the seabottom and be weighed by widing up the pennant wire from the tugboat or supply ship. Subsequently it can either be pulled or hoisted aboard the tugboat or the supply ship, or pulled to the floating object by winding up the anchor chain or cable from there so that it can be hoisted on deck or secured against an anchor frame.

The last-described method for retrieving an anchor would cause problems, however, as the anchor would penetrate more deeply into the sea-bottom. In the first place, the anchor shank can often not be reached by the "chaser" since this shank has dug itself in too deeply. Thus it will not be possible for the "chaser" to slide about the anchor shank, Secondly, the anchor chain of a deeply penetrated anchor has a rather steep angle of incident with respect to the sea-bottom. When winding up the pennant wire, the "chaser" tends to slide back along the anchor chain, until a certain balance of forces would be established in the system of anchor chain or cable and "chaser" engaging it. This would create great forces in the anchor chain or cable. The forces in the chain or cable thus directed towards the floating object and the anchor cause, as a result of 2nd order effects a far greater resulting force in the pennant wire towards the tugboat or supply ship than the force actually required for breaking-out the anchor. This has the unfavourable consequence that the anchor chain or cable and the pennant wire have to be dimensioned disproportionally more heavily and that the winch aboard the tugboat or supply ship has to yield much greater pulling forces. In spite of these necessary provisions there remains a chance of chain or cable breakage on account of the high level of the acting forces, particularly if the anchor is embedded rather firmly into the sea-bottom.

The present invention tends to eliminate these drawbacks and for this purpose the invention is characterized in that the "chaser" is provided with a sliding surface or sliding surfaces for an easy passage of an anchor chain or cable through or over the device in both directions and a one-way acting blocking means over which the passage of the anchor chain or the chain length as a member of an anchor cable in at least one direction is possible, but by which the latter can be blocked in the opposite direction.

The use of such a one-way acting blocking means or "chaser stopper" in a "permanent chaser" has the drawback, that the "chaser" after laying-out the anchor cannot be tugged back to the floating object along the anchor chain or the chain length of the anchor cable due to the blocking action in the opposite direction. One of the embodiments of the present invention tends to solve this problem and this embodiment is for that purpose characterized in that it is provided with an anti-blocking means which can release the one-way blocking action of the blocking means.

It should be remarked, that the blocking action of the "chaser stopper" concerns anchor chains. This does not exclude their use in anchor cables, provided that such anchor cables are provided with a chain length near the anchor, on which the "chaser stopper" can be operable. When in the following specification the word chain is used, this can both refer to an entire anchor chain and a chain length as a member of an anchor cable.

The invention will now be described in more detail in view of the attendant drawings and be further elucidated.

FIGS. 1*a* through 1*d* give, in this order, the successive stages of breaking-out a deeply penetrated anchor from the sea-bottom with a known device and in the pertaining force diagrams the forces occurring in every stage are schematically shown.

FIGS. 2*a* through 2*d*, in this order, give the successive stages of again breaking-out a deeply penetrated anchor from the sea-bottom with the device according to the present invention and an indication of the forces occurring in every stage.

Figure 3A:
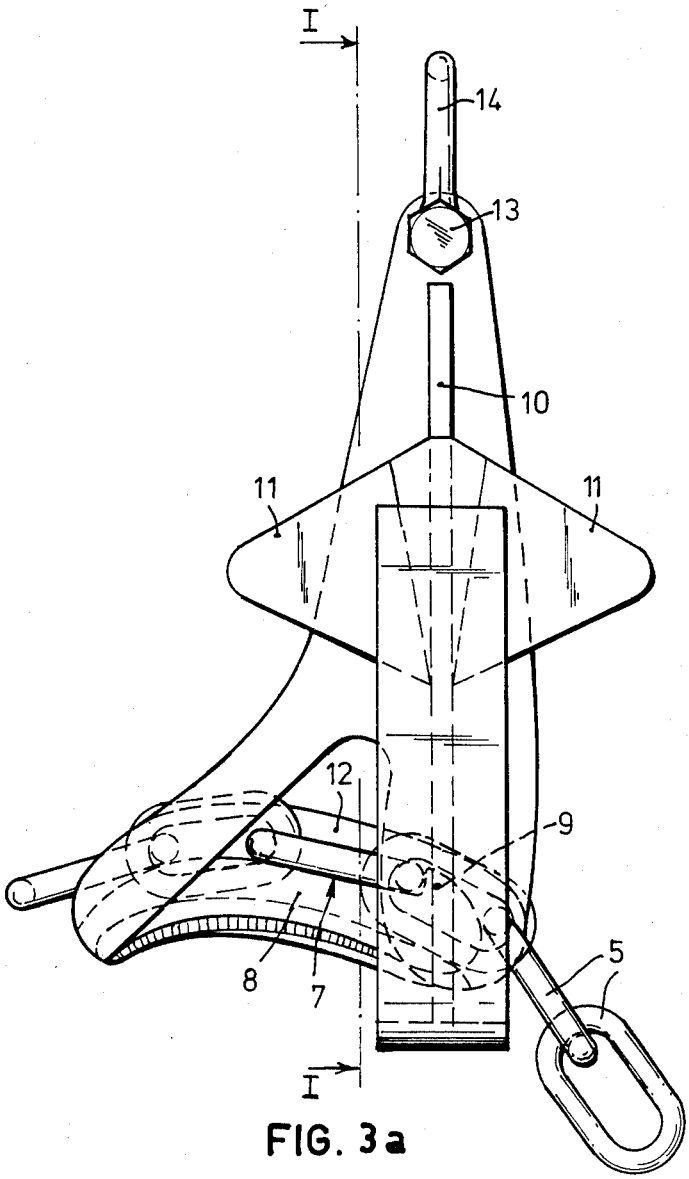

FIG. 3*a* shows a side view of a device according to the invention of the "J-chaser" type.

Figure 3B:
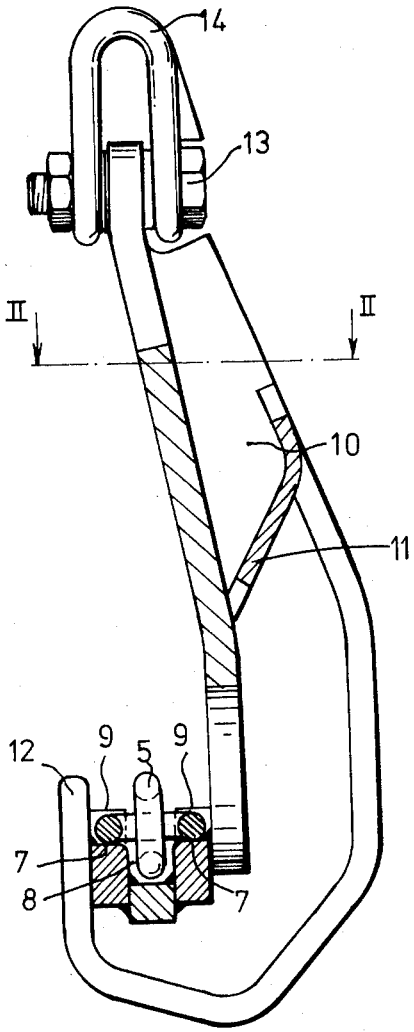

FIG. 3*b* shows a longitudinal cross section of the device according to FIG. 3*a* along the line I—I.

Figure 3C:
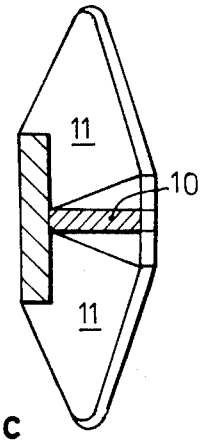

FIG. 3*c* shows a cross-section of the device according to FIG. 3*a* along the line II—II in FIG. 3*b*.

Figure 4A:
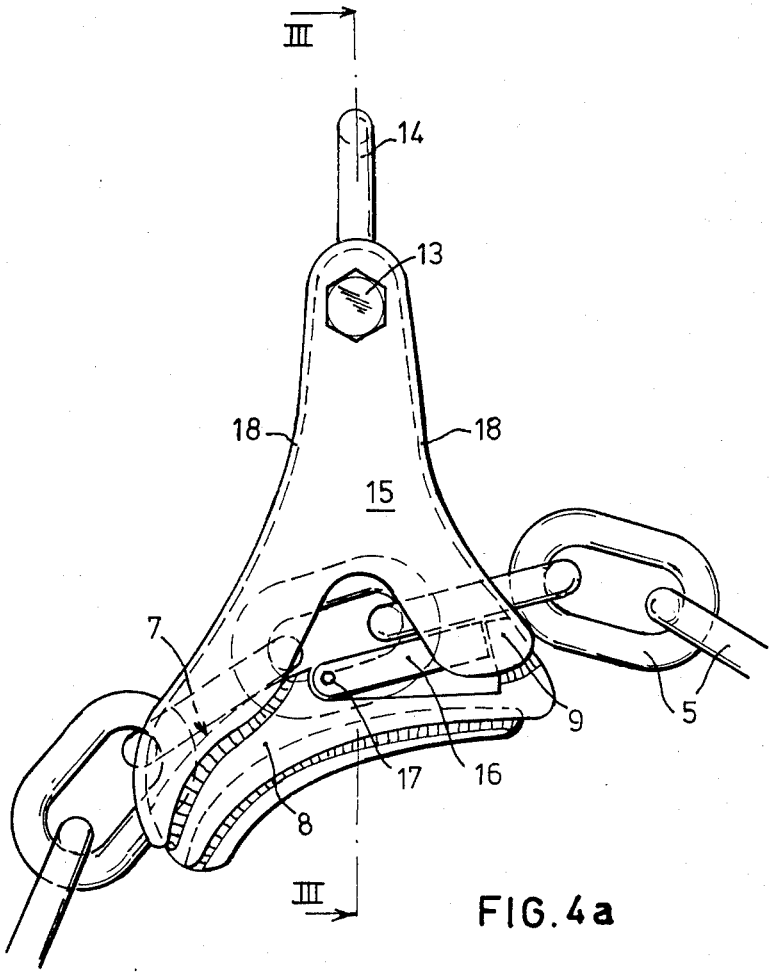

FIG. 4*a* shows a side view of a device according to the invention of the "permanent chaser" type.

Figure 4C:
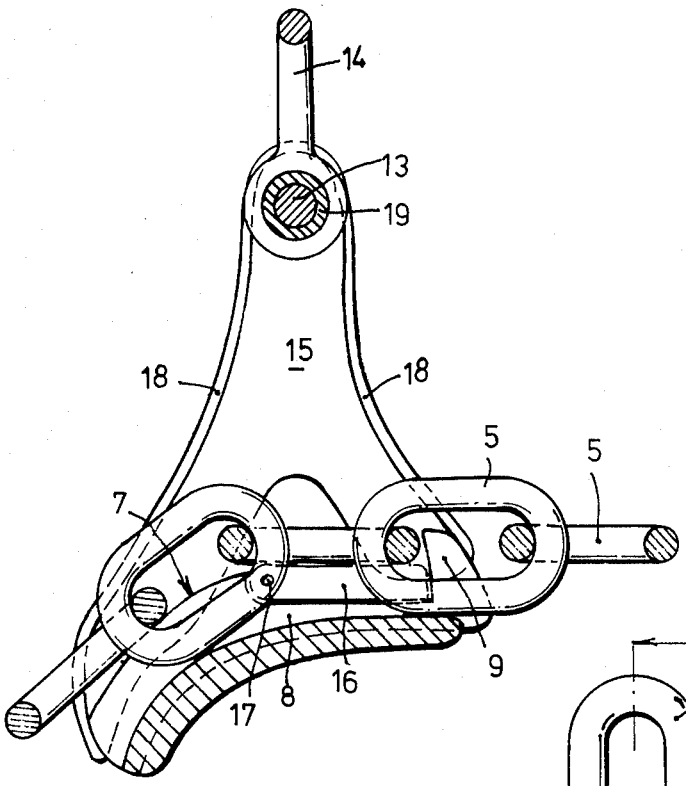
Figure 4B:
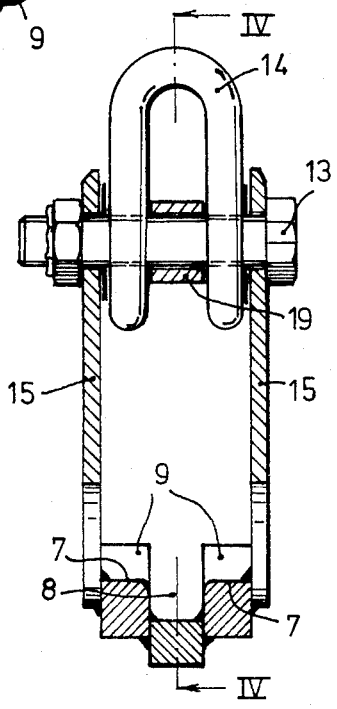

FIG. 4*b* shows a longitudinal cross-section of the device along the line III—III.

FIG. 4*c* shows a cross-section of the device according to FIG. 4*a* along the line IV—IV in FIG. 4*b*.

Figure 5:
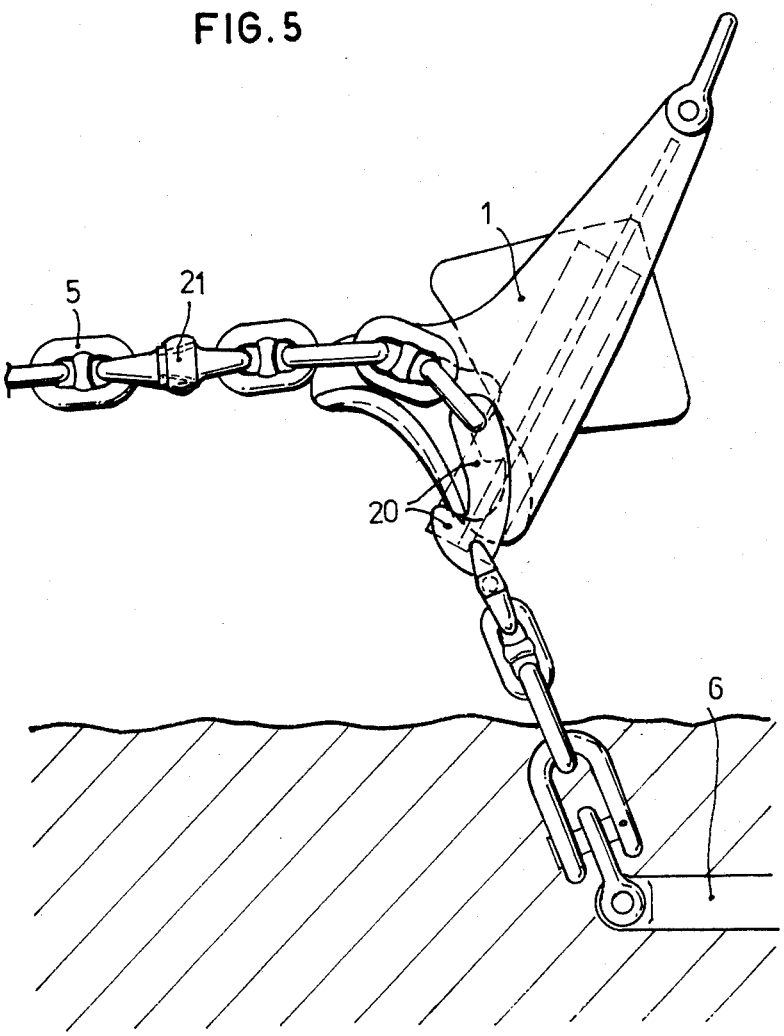

FIG. 5 shows the chain end near the anchor, in which chain end a fang means for the "chaser" is incorporated.

In FIG. 1*a* through 1*d* the problems are shown occurring when breaking-out a deeply penetrated anchor from the sea-bottom with the aid of a known device. In FIG. 1*a* a "chaser" 1 is tugged by a pennant wire 3 from the floating object 4 to be anchored (drilling platform, crane ship etc.) along the anchor chain or cable 5 in the direction of the anchor 6 with the aid of a tugboat or supply ship. In the enclosed diagram of forces is proportionally indicated how the forces are developed at the location of the point of engagement of the "chaser" 1 on the anchor chain or cable in the pennant wire and in the anchor chain or cable.

Figure 1B:
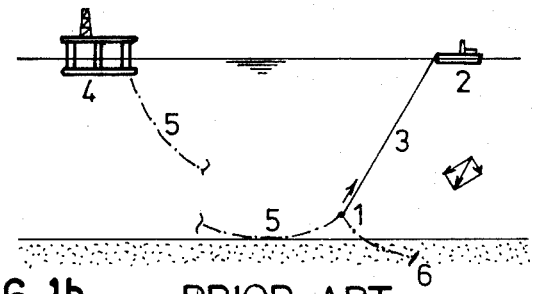
FIG. 1b PRIOR ART

Due to the deep penetration of the anchor 6 and the rather steep angle of incidence of the anchor chain 5 with respect to the sea-bottom the "chaser" is not capable to move towards the anchor and tends to slide back along the anchor chain or cable when winding up the pennant wire 3 from the tugboat or supply ship. This sliding back continues until a certain balance of forces has been reached. This stage is shown in FIG. 1*b*, as well as the schematically indicated acting forces in the balance situation.

Figure 1C:
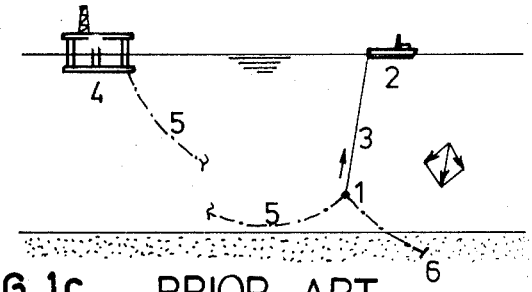
FIG. 1c PRIOR ART

In FIG. 1*c* the stage is shown in which by further winding up the pennant wire, a begin is made with actually breaking the anchor out of the sea-bottom. It can be read from the attendant diagram of forces, that the forces in both the chain and cable ends and in the pennant wire increase considerably.

Figure 1D:
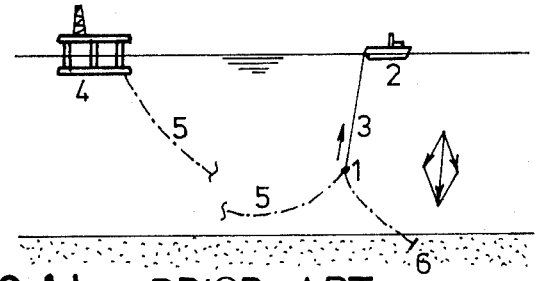
FIG. 1d PRIOR ART

FIG. 1*d* shows a following stage, in which as a result of the occurring great forces in the anchor chain or cable ends and on the basis of the balance of forces in the point of engagement, the force in the pennant wire increases excessively.

Figure 2A:
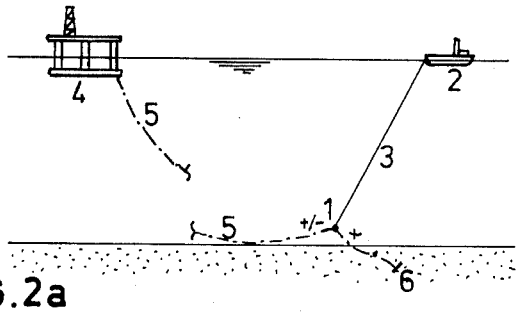
Figure 2B:
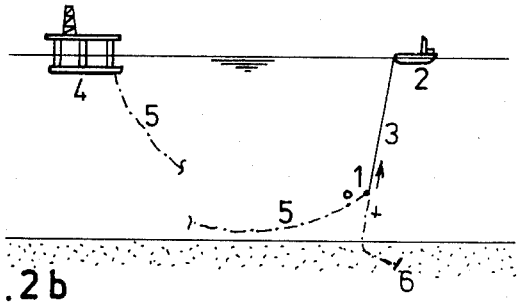

FIGS. 2*a* through 2*d* show the stages of breaking-out the anchor, whereby the device according to the invention is used. In FIG. 2*a* the device is about to slide back in the direction of the floating object 4. At that moment, the one-way acting blocking means, "chaser stopper" in technical terminology, becomes operative, by engaging the first occurring horizontal link of the chain returning through the "chaser" 1. Thus the chain is blocked in the "chaser" in the direction of the floating object, due to which as a result of the pennant wire being wound up from the tugboat 2, only the chain end running towards the anchor 6 is pulled taut (FIG. 2*b*). The forces in the chain end which is connected to the floating object, can be neglected.

Figure 2C:
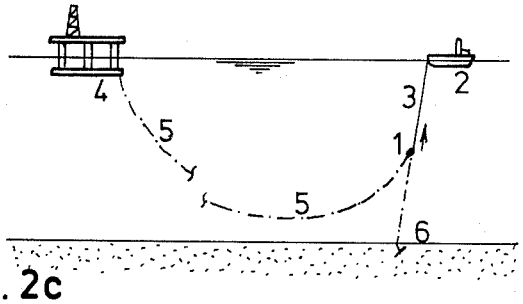

When further winding up the pennant wire, the anchor can subsequently be broken directly out of the sea-bottom, as is shown in FIG. 2*c*. Due to the lack of secondary forces (2nd order effects) in the chain ends, the required pulling force in the pennant wire remains restricted to the breaking-out force of the anchor.

Figure 2D:
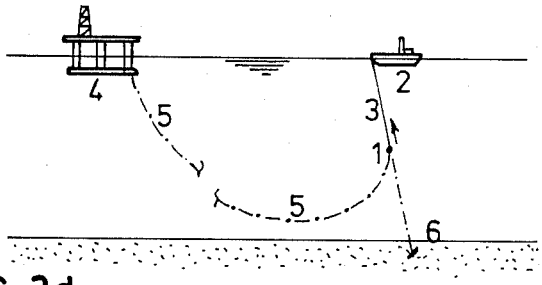

Since the "chaser" is now more or less secured to the chain, the tugboat or the supply ship can, in principle, pull the anchor in any desired direction, e.g., as indicated in FIG. 2*d*. This has the advantage that the anchor can be jerked free of the sea-bottom in the most favourable direction and at the most favourable angle.

In FIGS. 3*a* through 3*c* a device according to the invention of the "J-chaser" type is shown. The J-shaped support frame comprises two sliding surfaces on which horizontally positioned chain links can slide. These sliding surfaces are separated from each other by a recessed section 8 for an unhindered passage of vertically oriented chain links. The sliding surfaces are at one side of the device provided with stop cams 9. As long as the chain 5 according to FIG. 3*a* runs from the right to the left through the "chaser", or rather the "chaser" moves from the left to the right, the horizontal links can pass on the stop cams 9 unhindered. However, as soon as the direction of movement of the "chaser" is reversed, the first-occurring horizontal link engages the stop cams, whereby the passage of the chain through the "chaser" is blocked. This situation is shown in FIG. 3*a*. It is as if the "chaser" seizes on the chain, so that the hoisting force is transferred directly to the anchor via the tensioned chain portion (in FIG. 3*a* to be right of the "chaser").

The above-described situation occurs, when one wants to weigh an anchor. In this case the tugboat or the supply ship sails from the floating object over the anchor chain or cable from the left to the right, whereby the "chaser" is lowered into the water on the pennant wire over the stern roller. The "chaser" is provided with a rotary plate 10 and rotary triangles 11, which upon contacting the chain automatically turn the "chaser" into the right direction, after which the "chaser" can be hooked on the chain in a simple manner. Subsequently the "chaser" is "driven" in the direction of the anchor when sailing and such up to the earlier-mentioned moment at which the "chaser" tends to slide back along the chain. It is at that moment that the first-occurring chain link engases the stop cams 9 as described above.

A raised edge 12 warrants that once a chain is engaged, it continues to run also during the passage over the relatively high stop cams over the sliding surfaces 7. Furthermore this "J-chaser" is pivotally connected to a hoisting eye 14 by means of a bolt 13.

After the "chaser" has engaged the chain, the anchor is pulled out of the sea-bottom directly via the tensioned wire end situated between the "chaser" and the anchor and weighed, after which it can be hoisted aboard the tugboat or supply ship or aboard the floating object.

If this "J-chaser" is to be used for bringing an anchor on its location C.Q. for laying it out, this anchor has to be lowered from the floating object, hoisted aboard the tugboat or supply ship and then with the aid of the "chaser" lowered to its anchoring location. However, this implies that for lowering it from the floating object, a pennant wire should be attached to the anchor temporarily.

In FIGS. 4*d* through 4*c* a device according to the invention of the "permanent chaser" type is shown. This "chaser" is also provided with two sliding surfaces 7, on which horizontally positioned chain links can slide, and a recessed section 8 for the unhindered passage of vertically positioned links of the chain 5. These sliding surfaces are situated between the two side plates 15, which are kept spaced apart by means of a spacer 19. On account of the permanent character of this "chaser" type, the chain is also located permanently between these side plates.

Precisely on account of this permanent character of this "chaser" it is always oriented in one predetermined position with respect to the chain. Since the "chaser" has to be used both for laying-out and for again hauling an anchor, this implies that the "chaser" should be adapted to move in both directions along the chain if so desired. For, after laying-out an anchor with a "permanent chaser", this "chaser" has to be moved back along the anchor chain or cable in the direction of the floating object. However, the "chaser" would then engage the anchor chain or the chain length of an anchor cable, which would block this return movement. A solution to this problem was devised, in the form of an anti-blocking means. In this embodiment this anti-blocking means comprises canting arms 16 which can pivot about horizontal pivot shafts 17. Then the canting arms are located in the sliding surfaces 7 and that just before the stop cams 9.

They can be locked in two positions, depending on the desired "chaser" action, e.g. by locking them with a pawl mechanism.

When an anchor has to be laid out, the canting arms 16 are locked in closed position, i.e. canted upwards. Now the anchor chain or cable 5 can slide unhindered over the sliding surfaces 7 in both directions, due to which the "chaser" after the anchor has been laid out can be moved back to its position of rest against the anchor support frame of the floating object. This closed position of the canting arms is shown in FIG. 4*a*.

For hoisting again an anchor that was already laid out, the canting arms 16 are locked in opened position, i.e. canted downwards. Now the "chaser" can be moved unhindered from the floating object in the direction of the anchor: the anchor chain or cable runs unhindered from the right to the left over the stop cams 9 and via the lower sliding surfaces 7 located behind these on through the "chaser". At the moment the "chaser" is near the anchor and attempts to slide back along the anchor chain or the chain length of an anchor cable, the first occurring horizontal chain link abuts the stop cams 9, after which the chain end between the "chaser" and the anchor can be tensioned and the anchor can be pulled out of the sea-bottom. This engagement of a horizontal link behind the stop cams 9 in opened position of the canting arms 16 is shown in FIG. 4*c*, which figure represents a cross-section exactly along the centre line III—III of FIG. 4*b*.

However, for clarity's sake the canting arms 16 are not shown in section in FIG. 4*b*. Furthermore the side plates 15 could be bevelled or radiused at their inner side 18 for an easier passage of the anchor chain or cable. This "permanent chaser" is also pivotally connected to a hoisting eye by means of a bolt 13 via the spacer 19. In FIG. 5 the chain end 5 near the anchor is shown, in which chain end a fang means is incorporated so as to prevent the "chaser" from moving beyond this point and jamming on the anchor shackle ("crown shackle"). In the embodiment represented here this fang means consists of a fang hook 20, adapted to hook behind the lower side of the device.

In the chain end in question, a chain swivel 21 is also mounted. Due to rotation of this chain swivel, turns in the chain, if caused by pulling the chain not entirely straight when weighing the anchor, can be removed from the chain in a simple manner. Otherwise the chain swivel could be mounted both before and behind the fang hook.

Finally it is remarked, that the above-described embodiments should be regarded as non-restrictive examples of the inventive idea and that all kinds of modifications and variations of what is represented here could be embodied within the scope of the invention.

What is claimed is:

1. An anchor line depending device for laying out, breaking out and weighing an anchor, comprising sliding surface means for easy passage of an anchor chain or an anchor cable when provided with a chain length, characterized by a one-way acting blocking means over which the passage of the anchor chain or said chain length as a member of an anchor cable in at least one direction is possible, but by which the latter can be blocked in the opposite direction, said blocking means comprising one-way acting stop cams which are integrally formed with said sliding surface means on which horizontally positioned chain links can slide and which are separated from one another by a recessed section for an unhindered passage of vertically oriented chain links.

2. A device as claimed in claim 1, characterized in that it consists of an open structure with a J-shaped frame comprising a hook means, wherein the frame is provided with a plate at the side away from said hook means, and triangles at each side laterally of said hook means for automatically turning the device upon contact with an anchor chain or cable towards an orientation wherein said chain or cable is at the side of its hook means.

3. A device as claimed in claim 1, characterized in that it consists of a closed structure which is permanently around the anchor chain or cable, and which comprises an anti-blocking means by which the one-way blocking action of the blocking means can be eliminated.

4. A device as claimed in claim 1, characterized in that the stop cams are located at one end of said sliding surfaces.

5. A device as claimed in claim 3, characterized in that the anti-blocking means comprises canting arms which are located just before the stop cams and can pivot around a horizontal axis, said canting arms in closed position ensuring an unhindered passage of an anchor chain or cable in both directions an in opened position releasing the stop cams so that the movement of the anchor chain or the chain length as a member of the anchor cable is then blocked in one direction by the stop cams.

6. A device as claimed in claim 1, characterized in that in the chain end near the anchor a fang means is incorporated so that a possible movement of the device toward the anchor beyond this point is prevented.

7. A device as claimed in claim 6, characterized in that the fang means consists of a fang hook adapted to hook behind the lower side of the device.

* * * * *